United States Patent [19]

Raymond et al.

[11] Patent Number: 4,854,216

[45] Date of Patent: Aug. 8, 1989

[54] AMMUNITION HANDLING APPARATUS

[75] Inventors: Eugene B. Raymond, Essex Junction; Edward A. Proulx, Burlington, both of Vt.

[73] Assignee: General Electric Company, Burlington, Vt.

[21] Appl. No.: 220,759

[22] Filed: Jul. 11, 1988

[51] Int. Cl.[4] ..... F41D 10/04

[52] U.S. Cl. ..... 89/33.16; 89/33.25

[58] Field of Search ..... 89/33.14, 33.16, 33.17, 89/33.2, 33.25, 34

[56] References Cited

U.S. PATENT DOCUMENTS

| | | | |
|---|---|---|---|
| 421,862 | 2/1890 | Goodell | 89/33.17 |
| 2,830,498 | 4/1958 | Maillard | 89/33.17 |
| 2,908,200 | 10/1959 | Linke | 89/1.7 |
| 3,101,647 | 8/1963 | Greene | 89/33.14 |
| 3,170,372 | 2/1965 | Stanton et al. | 89/33.16 |
| 3,186,303 | 6/1965 | Linke et al. | 89/33.16 |
| 3,618,454 | 11/1971 | Christenson | 89/33.14 |
| 3,696,704 | 10/1972 | Backus et al. | 89/34 |
| 4,252,049 | 2/1981 | Franz | 89/34 |
| 4,373,422 | 2/1983 | Washburn et al. | 89/33.25 |
| 4,434,699 | 3/1984 | Tassie | 89/33.25 |
| 4,781,100 | 11/1988 | Baldwin | 89/33.25 |

FOREIGN PATENT DOCUMENTS

| | | | |
|---|---|---|---|
| 193950 | 2/1938 | Switzerland | 89/33.25 |

*Primary Examiner*—Deborah L. Kyle
*Assistant Examiner*—Stephen Johnson
*Attorney, Agent, or Firm*—Bailin L. Kuch; Robert A. Cahill

[57] ABSTRACT

To provide positive, uninterrupted control and guidance of ammunition rounds being transferred through a transfer zone to and from an ammunition conveyor in an ammunition handling system, a set of commonly mounted, rotary control members are provided with a plurality of angularly spaced, radiating control elements whose free ends provide separate control surfaces which guidingly engage and move with the ammunition rounds as they are being transferred in opposite directions through the transfer zone.

17 Claims, 3 Drawing Sheets

AMMUNITION HANDLING APPARATUS

The present invention relates to ammunition handling apparatus and particularly to improve apparatus for reliably controlling the transfer of linkless rounds of ammunition to and from an ammunition conveyor.

BACKGROUND OF THE INVENTION

At the high conveying speeds required of modern ammunition handling apparatus, the transfer of linkless rounds of ammunition between conveyors of associated equipment is always of major concern. Such transfers occur between the conveyor of replenishing or reloading equipment and the magazine conveyor of a rapid-fire gun system where live ammunition rounds are handed off from the reloading conveyor to the magazine conveyor typically in exchange for spent ammunition rounds or spent shell cases stored on the magazine conveyor. Such transfers also occur when live ammunition rounds are handed off from the magazine conveyor to the gun conveyor, again typically in exchange for spent ammunition rounds. At these round transfer locations, there is invariably a "dead zone" where positive control of ammunition round movement is momentarily lost. This dead zone is characterized by the hiatus or gap in at least one of the ammunition round control or guide surfaces at the transition between the ammunition round conveyor path and the round transfer path or paths therebeyond. This round control gap is necessary to afford clearance for the ammunition conveyor as it moves through the round transfer location which is ideally located at the outboard side of a folded loop in the conveyor path.

Heretofore, the design approach addressing this dead zone problem has simply been to minimize the width of the round control gap. Thus, the ammunition round carriers of the conveyor have been reduced in cross section or notched to accommodate greater penetration of diverting guide surfaces or deflectors into the round control gap (dead zone). However, this significantly reduces the stiffness and strength of the conveyor carriers, and thus jeopardizes their structural integrity against the extreme stresses encountered during high speed round conveyance.

It is accordingly an object of the present invention to provide improved apparatus for handling linkless rounds of ammunition.

An additional object is to provide improved apparatus of the above-character, wherein the transfer of ammunition rounds to and from an ammunition conveyor is effected without loss of positive control over the transferred rounds.

A further object is to provide improved apparatus of the above-character, wherein the dead zone or round control gap for transferred rounds is virtually eliminated.

Another object is to provide improved apparatus of the above character, wherein the control of rounds both transferred to and transferred from an ammunition conveyor is achieved by common control means.

A still further object is to provide improved apparatus of the above-character, which is efficient in construction, convenient to manufacture, and reliable in operation over a long service life.

Other objects of the invention will in part be obvious and in part appear hereinafter.

SUMMARY OF THE INVENTION

In accordance with the present invention, there is provided improved ammunition handing apparatus including a conveyor for conveying linkless rounds of ammunition (live and spent rounds) to and from a round transfer zone located outboard of a turnaround sprocket about which the conveyor is trained in a folded loop. Sets of opposed inner and outer guide surfaces control round movement along prescribed conveyor paths during conveyance by the conveyor to and from the round transfer zone. The outer, conveyor path guide surfaces continue beyond the round transfer zone to provide with opposed inner guide surfaces control and guidance of transferred rounds moving in separate transfer paths to and from the ammunition conveyor.

To afford positive control of the transferred rounds during transition of the gaps between the delivery and transfer path inner guide surfaces, at least one round control member is mounted inboard of the conveyor loop for driven rotation in coordination with the turnaround sprocket. This control member carries a plurality of angularly spaced, peripheral guide surfaces which swing through the gaps between the conveyor and transfer path inner guide surfaces to engagingly control the ammunition rounds while transitioning the gaps during round transfer through the round transfer zone between the delivery and transfer paths.

The invention accordingly comprises the features of construction, combination of elements and arrangement of parts, all of which will be exemplified in the description hereinafter set forth, and the scope of the invention will be indicated in the claims.

For a fuller understanding of the nature and objects of the present invention, reference may be had to the following detailed description taken in conjunction with the accompanying drawings, in which.

Like references numerals refer to corresponding parts throughout the several view of the drawings.

DETAILED DESCRIPTION

Figure 1:
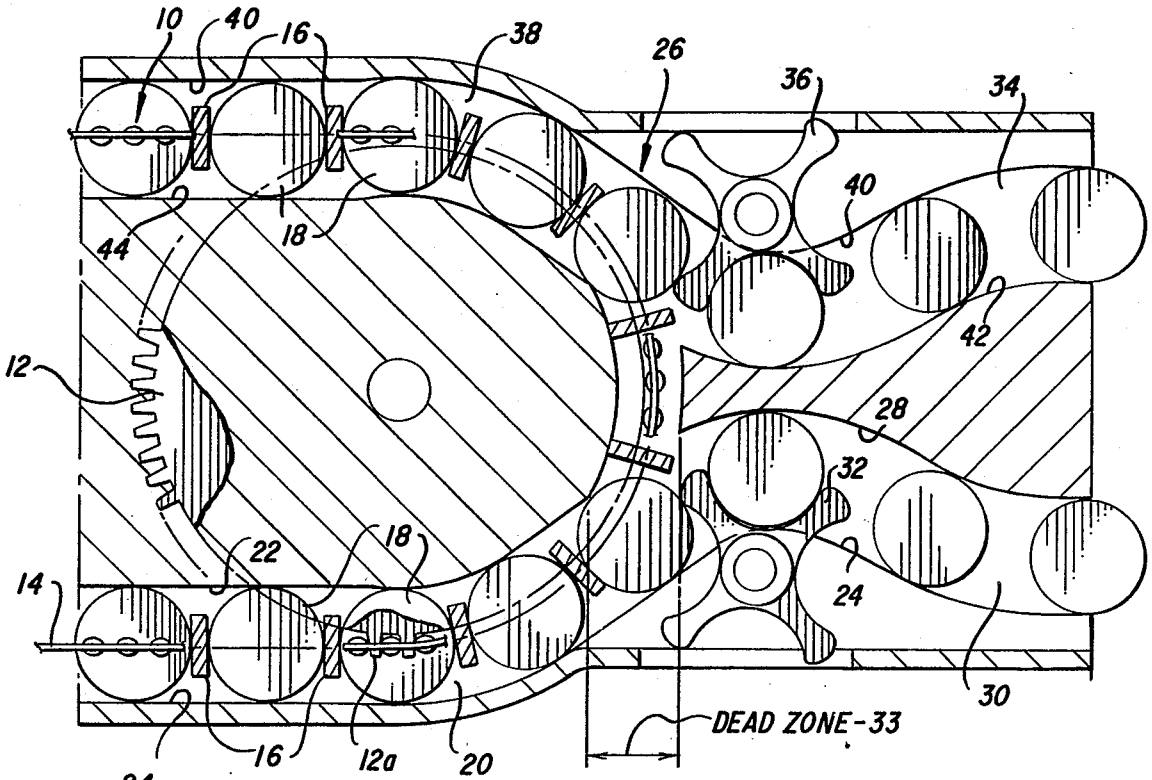
FIG. 1 (PRIOR ART)
FIG. 1 is side elevational view of a representative prior art ammunition handling apparatus.

In the prior art ammunition handling apparatus seen in FIG. 1, a chain ladder conveyor, generally indicated at 10, is trained around a pair of transversely spaced turnaround sprockets, one seen at 12. The conveyor includes a pair of transversely spaced chains, one seen at 14, which are drivingly engaged by the teeth 12a of the turnaround sprocket pair. The chains 14 are interconnected at uniformly spaced intervals along their lengths by transverse carrier members 16 in the manner of ladder rings. Linkless rounds of ammunition 18 are accommodated in the spaces between each adjacent pair of carrier members 16 for conveyance by conveyor 10. Assuming counter clockwise rotation of the turnaround sprockets 12, ammunition rounds are conveyed along a conveyor path 20 defined between inner round guide surfaces 22 and outer round guide surfaces 24 to a round transfer zone, generally indicated at 26. Outer round guide surfaces 24 continue beyond the round transfer zone to define with inner round guide surfaces 28 a round transfer path 30 into which ammunition rounds are diverted or handed off from conveyor path 20. Driven transfer sprockets 32 engage the transferred rounds and propel them along transfer path 30 away from the round transfer zone 26.

It is seen from FIG. 1 that, as the ammunition rounds make the transition between their conveyor path 20 to their transfer path 30 through round transfer zone 26, there is continuity in the outer guide surfaces 24, but a gap exists between the inner guide surfaces 22 and 28. This represents a "dead zone" or hiatus in full, positive control over the ammunition rounds as they move through the round transfer point, as indicated at 33 in FIG. 1. It will be appreciated that this inner guide surface control gap is necessary to provide clearance for ammunition conveyor carrier members 16. While the illustrated dimension of this dead zone gap is less then the round diameter, its existence can be disruptive to the smooth flow of ammunition rounds through the transfer point, particularly at high feed rates. Such disruptions, at best, result in excessive wear, possible damage to the ammunition rounds, and represent additional mechanical losses which conveyor power source must overcome. At worst, a jam could result.

This dead zone problem is exacerbated two-fold, when, as illustrated in FIG. 1, there is also a transfer of ammunition rounds to conveyor 10. This is a typical situation when live ammunition rounds are handed off from the conveyor to transfer sprockets 32 for conveyance along transfer path 30, while spent rounds or shell cases are conveyed along a separate transfer path 34 toward round transfer zone 26 and handed off by driven transfer sprockets 36 to conveyor 10 for conveyance along a conveyor path 38 away from the round transfer zone. It is seen that transfer path 34 is defined by outer guide surfaces 40 and inner guide surfaces 42, while conveyor path 38 is defined by outer guide surfaces 40 and inner guide surfaces 44. Thus, a dead zone gap exists between inner guide surfaces 42 and 44 corresponding to the one between inner guide surfaces 22 and 28.

Figure 2:
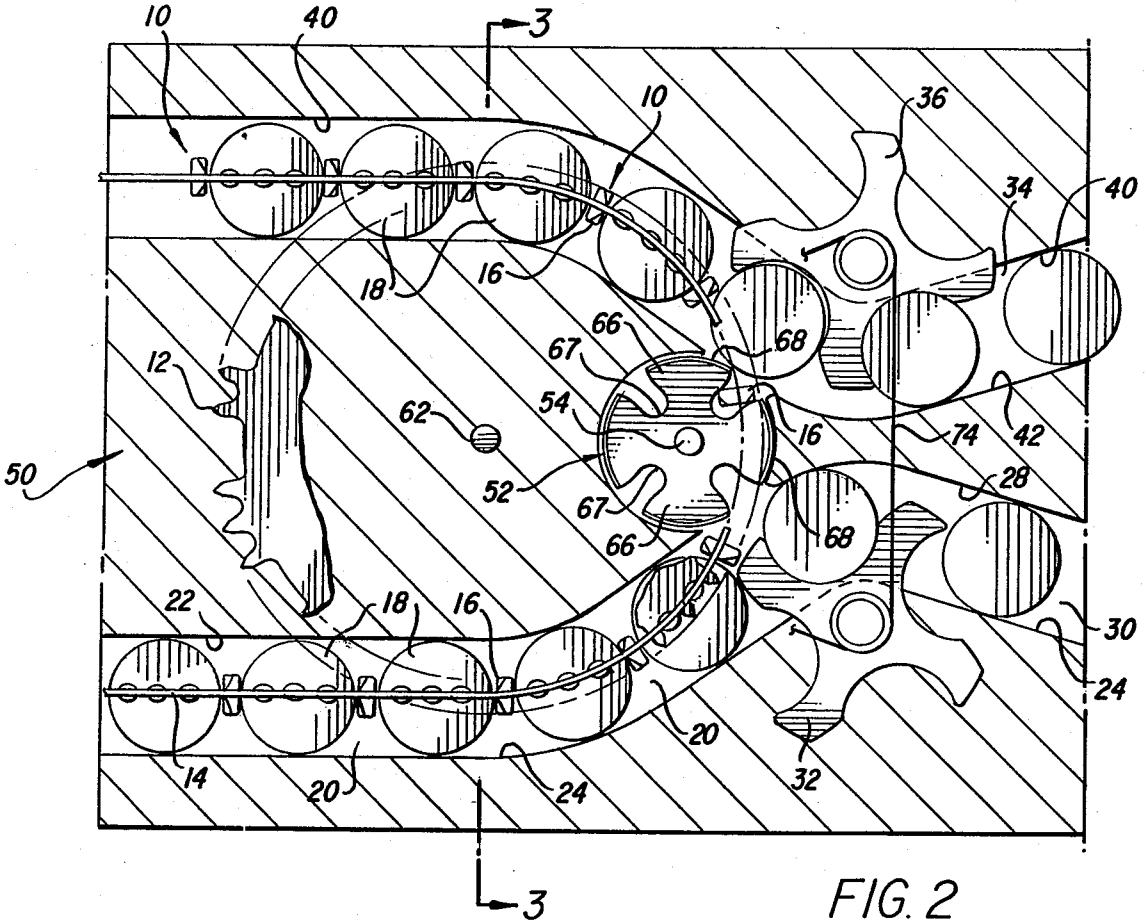
FIG. 2 is a side elevational view of an ammunition handling apparatus embodying the present invention.
Figure 3:
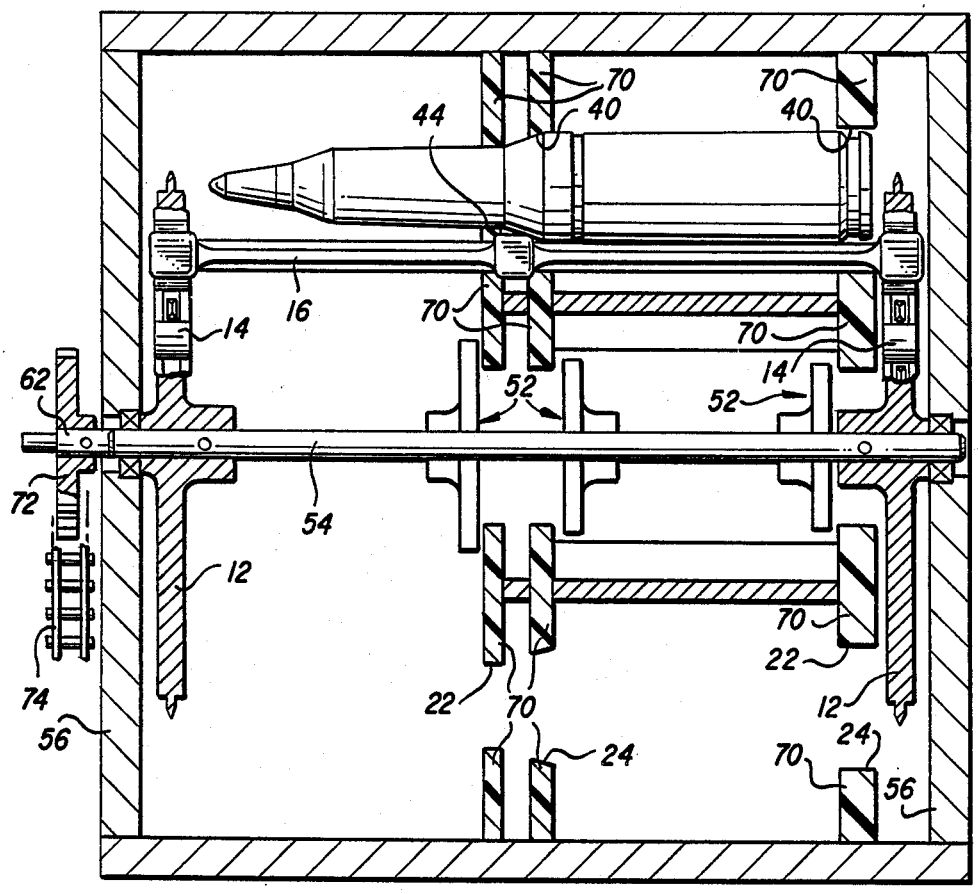
FIG. 3 is a sectional view taken along line 3—3 of FIG. 2.

To effectively eliminate the dead zone gap and avoid all of the problems engendered thereby, the ammunition handling apparatus of the present invention, generally indicated at 50 in FIGS. 2 and 3, incorporates at least one and preferably a set of transversely spaced, rotary ammunition round control members, generally indicated at 52. These members are mounted on a cross shaft 54 journalled at its ends by opposed housing sidewalls 56 (FIG. 3). Each control member 52 includes a plurality (four in the illustrated embodiment) of equally angularly spaced, radiating control elements 66 separated by deep grooves or pockets 67. The control members are positioned inboard of the conveyor loop about turnaround sprocket 12 in opposed, proximate relation to round transfer zone 26. The control members are driven by the engagement of successive carrier members 16 in pockets 67 for common rotation in synchronism with conveyor 10. Control elements 66 thus swing through the space corresponding to the dead zone in FIG. 1 to present their peripheral, free end surfaces as moving inner guide or control surfaces 68 spanning the gaps between inner guide surface 22, 28 and 42, 44. That is, the lengths of the control elements are such that their control surfaces effectively blend with the trailing edges of the inner guides surfaces as the ammunition rounds arrive and move with the rounds through the round transfer zone to blend with the leading edges of the aligned inner guide surfaces as the rounds depart the round transfer zone. In doing so, these moving around control surfaces guide the ammunition rounds so as to closely follow the outer guide surfaces.

It will be noted that the control members 52 serve in both the transfer of rounds from conveyor path 20 to transfer path 30 and the transfer of rounds from transfer path 34 to conveyor path 38. That is, while the control surfaces 68 carried by one set of transversely aligned control elements 66 swing through the gap between inner guide surfaces 22, 28 to provide inboard guidance and control for rounds handed off to transfer sprockets 32, another set of transversely aligned control elements swing through the gap between inner guide surfaces 42, 44 to provide guidance and control for rounds handed off by transfer sprockets 36 to the slots between adjacent carrier members 16 of ammunition conveyor 10. In each case, the moving control surfaces 68 force the rounds transiting round transfer point 26 to closely follow the outer guide surfaces 24, 40 in a smooth, free-flowing manner.

As seen in FIG. 3, the inner and outer guide surfaces are in the form of transversely spaced ribs 70 which penetrate the conveyor paths in varying degrees in conformance with the round profile to also provide control over the transverse position of the ammunition rounds 18 during conveyance by conveyor 10. Also, the lengths of the control elements arms 66 of the transversely spaced control members 52 are appropriately varied depending on their transverse positions so as to conform with the round profile. While the control members are shown in FIG. 3, as being transversely offset from their associated inner guide surfaces, it will be appreciated that they may be in longitudinal alignment. As also seen in FIG. 3, turnaround sprocket shaft 62 is fitted with a sprocket 72 from which synchronized drive is taken for the transfer sprockets via an interconnecting chain seen diagrammatically at 74 in FIG. 2.

It is important to note that by providing the surfaces 68 at the free ends of the angularly spaced control elements 66, the control members 52 serve the round control function without interferring with ammunition conveyor 10. The control elements simply step over the carrier members 16 as they are accepted in pockets 67 to impart synchronized rotation to the control members while moving through round transfer zone 26. Moreover, it is seen that the control members are effective in guiding the rounds through the round transfer point regardless of their direction of movement. As illustrated, the control members are driven in the counterclockwise direction to guide rounds from conveyor path 20 to transfer path 30 and from transfer path 34 to conveyor path 38. The turnaround sprockets 12 and control members 52 can be driven in the clockwise direction, such that the rounds are guided by the revolving guide surfaces 68 through round transfer point 26 in respective opposite directions from conveyor path 38 to transfer path 34 and from transfer path 30 to conveyor path 20.

It is thus seen that the object set forth above, including those made apparent from the preceding description are efficiently attained, and, since certain changes may be made in the disclosed construction without departing from the present invention, it is intended that the details embodied therein shall be interpreted as illustrative and not in a limiting sense.

Having described the invention, what is claimed as new and desired to secure by Letters Patent is:

1. An ammunition handling apparatus comprising, in combination:

A. a driven chain ladder conveyor having a pair of parallel, spaced chains interconnected by a succession of transverse carrier members spaced apart along a length of said conveyor to accommodate therebetween ammunition rounds for conveyance;

B. a driven set of turnaround sprockets about which said conveyor is trained in a folded loop at a round transfer zone;

C. first and second inner guide surfaces disposed in gapped relation and extending generally in opposite directions away from said round transfer zone;

D. a first outer guide surface situated in opposed, spaced relation with said first inner guide surface to retain the ammunition rounds between said carrier members during conveyance by said conveyor along a first conveyor path, said first outer guide surface situated in opposed, spaced relation to said second inner guide surface to guide ammunition round movement along a first transfer path beyond said round transfer zone from said first conveyor path; and E. at least one ammunition round control member mounted within said conveyor loop for driven rotation in synchronism with said turnaround sprockets, said member carrying a plurality of angularly spaced, control surfaces cooperating with said first outer guide surface at the gap between said first and second inner guide surfaces to control a transfer of successive ammunition rounds between said first conveyor path and said first transfer path through said round transfer zone.

2. The ammunition handling system defined in claim 1, wherein said round control member includes a plurality of radiating control elements having free ends carrying said control surfaces.

3. The ammunition handling system defined in claim 2, wherein said control member further includes grooves angularly separating said control elements, said transverse carrier members being received in said grooves to drivingly rotate said control member.

4. The ammunition handling system defined in claim 3, wherein said turnaround sprockets are mounted on a first cross shaft, and said control member is mounted on a second cross shaft intermediate said first cross shaft and said round transfer zone.

5. The ammunition handling system defined in claim 4, which further includes a plurality of said control members mounted in spaced relation on said second cross shaft.

6. The ammunition handling system defined in claim 5, wherein the ammunition rounds have a predetermined profile, and wherein said control elements of any one of said control members are of equal lengths, the lengths of said control elements varying from one of said control members to another in accordance with the predetermined profile of the ammunition rounds.

7. The ammunition handling system defined in claim 5, which further includes at least one round-engaging transfer sprocket driven in synchronism with said turnaround sprockets and said control member to propel successive ammunition rounds along said first transfer path.

8. The ammunition handling system defined in claim 1, which further includes third and fourth inner guide surfaces disposed in gapped relation and extending in generally opposite directions away from said round transfer zone, and a second outer guide surface situated in opposed, spaced relation with said third inner guide surface to retain ammunition rounds between said carrier members during conveyance by said conveyor along a second conveyor path, said second outer guide surface situated in opposed, spaced relation to said forth inner guide surface to guide ammunition round movement along a second transfer path beyond said round transfer zone from said second conveyor path, said control surfaces of said control member cooperating with said second outer guide surface at the gap between said third and fourth inner guide surfaces to control a transfer of successive ammunition rounds between said second conveyor path and said second transfer path through said round transfer zone.

9. The ammunition handling system defined in claim 8, wherein one of said control surfaces swings through the gap between said first and second inner guide surfaces to control a transfer of an ammunition round from said first conveyor path to said first transfer path while another one of said control surfaces swings through the gap between said third and forth inner guide surfaces to control a transfer of another ammunition round from said second transfer path to said second conveyor path.

10. The ammunition handling system defined in claim 9, wherein said round control member includes a plurality of radiating control elements having free ends carrying said control surfaces.

11. The ammunition handling system defined in claim 10, wherein said control member further includes grooves angularly separating said control elements, said transverse carrier members being received in said grooves to drivingly rotate said control member.

12. The ammunition handling system defined in claim 11, wherein said turnaround sprockets are mounted on a first cross shaft, and said control member is mounted on a second cross shaft intermediate said first cross shaft and said round transfer zone.

13. The ammunition handling system defined in claim 12, which further includes a plurality of said control members mounted in spaced relation on said second cross shaft.

14. The ammunition handling system defined in claim 13, wherein the ammunition rounds have a predetermined profile, and wherein said control elements of any one of said control members are of equal lengths, the lengths of said control elements varying from one of said control members to another in accordance with the predetermined profile of the ammunition rounds.

15. The ammunition handling system defined in claim 14, which further includes round-engaging transfer sprockets driven in synchronism with said turnaround sprockets and said control members to propel successive ammunition rounds along said first and second transfer paths.

16. An article handling apparatus comprising, in combination:

A. a driven chain ladder conveyor having a pair of parallel, spaced chains interconnected by a succession of transverse carrier members spaced apart along a length of said conveyor to accomodate therebetween articles for conveyance;

B. a driven set of turnaround sprockets about which said conveyor is trained in a folded loop at an article transfer zone;

C. a first inner guide surface and a second inner guide surface disposed in gapped relation and extending generally in opposite directions away from said article transfer zone;

D. a first outer guide surface situated in opposed, spaced relation with said first inner guide surface to retain the articles between said carrier members during conveyance by said conveyor along a first conveyor path, said first outer guide surface situated in opposed, spaced relation to said second inner guide surface to guide article movement along a first transfer path beyond said article transfer zone from said first conveyor path; and E. at least one article control member mounted within said conveyor loop for driven rotation in synchronism with said turnaround sprockets, said member carrying a plurality of angularly spaced, control surfaces cooperating with said first outer guide surface at a gap between said first and second inner guide surfaces to control the transfer of successive articles between said first conveyor path and said first transfer path through said article transfer zone.

17. The ammunition handling system defined in claim 16, which further includes third and fourth inner guide surfaces disposed in gapped relation and extending in generally opposite directions away from said article transfer zone, and a second outer guide surface situated in opposed, spaced relation with said third inner guide surface to retain articles between said carrier members during conveyance by said conveyor along a second conveyor path, said second outer guide surface situated in opposed, spaced relation to said forth inner guide surface to guide article movement along a second transfer path beyond said article transfer zone from said second conveyor path, said control surfaces of said control member cooperating with said second outer guide surface at the gap between said third and fourth inner guide surfaces to control a transfer of successive articles between said second conveyor path and said second transfer path through said article transfer zone.

* * * * *